US007819203B2

(12) United States Patent
Sato et al.

(10) Patent No.: US 7,819,203 B2
(45) Date of Patent: Oct. 26, 2010

(54) STRIKING TOOL

(75) Inventors: Shinichiro Sato, Ibaraki (JP); Tsukasa Suzuura, Ibaraki (JP); Takahiro Hirai, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/146,140

(22) Filed: Jun. 7, 2005

(65) Prior Publication Data

US 2005/0269117 A1 Dec. 8, 2005

(30) Foreign Application Priority Data

Jun. 8, 2004 (JP) ..... P2004-169301

(51) Int. Cl.
*B25D 9/00* (2006.01)

(52) U.S. Cl. ..... 173/210; 173/212; 173/200; 173/204; 173/128; 173/211; 173/162.1; 173/162.2; 279/19; 279/19.7

(58) Field of Classification Search ..... 173/210, 173/212, 200, 204, 211, 128, 162.1, 162.2; 279/19, 19.7
See application file for complete search history.

(56) References Cited

U.S. PATENT DOCUMENTS 1,887,762 A * 11/1932 Horton ..... 74/55
2,172,782 A * 9/1939 Alexander ..... 173/211
2,519,477 A * 8/1950 Kind ..... 173/118
3,114,421 A * 12/1963 McCloud ..... 173/14
3,788,404 A 1/1974 Koudelka et al.
3,824,417 A * 7/1974 Moores, Jr. ..... 310/51
3,847,229 A * 11/1974 Wanner et al. ..... 173/48
4,310,055 A * 1/1982 Wanner et al. ..... 173/118
4,336,848 A * 6/1982 Wanner ..... 173/210
4,476,941 A * 10/1984 Buck et al. ..... 173/117
4,602,689 A * 7/1986 Wanner ..... 173/127
5,370,193 A 12/1994 Sippus et al.
5,871,059 A * 2/1999 Shibata et al. ..... 173/211
6,948,571 B2 * 9/2005 Hanke et al. ..... 173/201
7,124,840 B2 * 10/2006 Miyakawa ..... 173/162.1

FOREIGN PATENT DOCUMENTS

EP 0 280 195 2/1988
JP 59-214571 12/1984

(Continued)

OTHER PUBLICATIONS

English Translation of Japanese Patent Application No. 60-172681.*

*Primary Examiner*—Rianldi I. Rada
*Assistant Examiner*—Michelle Lopez
(74) *Attorney, Agent, or Firm*—McGinn IP Law Group, PLLC

(57) ABSTRACT

An impact force is transmitted to a tip end tool due to the changes of the air pressure within an air chamber generated by the reciprocal operation of the piston within a striker. The attachment portion of a tip end tool holding member for holding the tip end tool to a cylinder casing is sandwiched between buffers disposed in the two directions of the axial direction of the tool thereby to elastically support the tip end tool holding member to be movable in the two directions of the axial direction of the tool.

17 Claims, 7 Drawing Sheets

FOREIGN PATENT DOCUMENTS

| | | |
|---|---|---|
| JP | 60-172681 | 11/1985 |
| JP | 61-137483 | 6/1986 |
| JP | 61-293777 | 12/1986 |
| JP | 07-063944 | 3/1995 |
| JP | 07-332435 | 12/1995 |

* cited by examiner

RELATED ART

RELATED ART

RELATED ART

STRIKING TOOL

BACKGROUND OF THE INVENTION

1. Field of the Invention

The present invention relates to a striking tool which performs various operations such as chipping, crushing of a member to be scraped such as concrete.

2. Description of the Related Art

A striking tool has been known which is driven by a motor and arranged to perform the various operations such as chipping, crushing of a member to be scraped such as concrete. An example of such a striking tool is shown in FIGS. 6 and 7.

That is, FIG. 6 is a perspective view showing the external appearance of a conventional striking tool 101 and FIG. 7 is a partially-broken longitudinal sectional diagram of the striking tool 101. As shown in FIG. 7, in the striking tool 101, the rotation of a motor 102 housed within a motor casing 103 is transmitted to a crank shaft 114 by means of a pinion 106, a counter gear 117 and a final gear 118 within a gear cover 108, whereby the crank shaft 114 is driven and rotated. Then, the rotation movement of the crank shaft 114 is converted into the reciprocal linear movement of a piston 125 by a con rod 127. Thus, since the pressure of the air within an air chamber 126 defined by a piston 125 within a striker 124 changes due to the reciprocal operation of the piston 125, the striker 124 reciprocally moves within a cylinder casing 119 and so intermittently collides with an intermediate member 131. As a result, the striking force from the intermediate member 131 is transmitted to a tip end tool 132 which is fit within a tip end tool holding member 121 so as to be able to slide therein freely, whereby a required operation such as chipping, crushing of a scraped member such as concrete can be performed.

However, in such a kind of striking tool 101, since the tip end tool holding member 121 for holding the tip end tool 132 is rigidly coupled to the cylinder casing 119 by means of bolts 122, an impact force generated at the tip end tool holding member 121 is transmitted to the cylinder casing 119, the motor casing 103, the gear cover 108 etc. as it is. Thus, noise is generated from these members and further the damages of respective portions such as the breakage at a portion near the handle 110 are raised, whereby there arises a problem that the durable life time of the striking tool 101 is degraded.

In view of the aforesaid conventional technique, an impact force attenuation structure shown in FIGS. 8 and 9 is proposed (see JP-U-A-60-172681).

That is, FIG. 8 shows a longitudinal sectional view of the tip end portion of a striking tool and FIG. 9 is an enlarged diagram showing the details of a portion C in FIG. 8. In these figures, a reference numeral 220 depicts a cylinder housed within a cylinder casing 219, 224 a striker fit within the cylinder 220 so as to be able to slide therein freely, 231 an intermediate member, and 221*a* tip and tool holding member for holding the member 232.

The tip end tool holding member 221 is attached to the cylinder casing 219 in a manner that the flange portion 221*a* thereof is abutted against the front end surface of the cylinder casing 219 and the flange portion 221*a* is fastened to the cylinder casing 219 by passing bolts 222 therethrough and fastening the bolts. A buffer member 242 is sandwiched between the flange portion 221*a* and a plate 245 to constitute the impact force attenuation structure. To be concrete, as shown in FIG. 9, a collar 244 is passed through the tip end tool holding member 221 and the buffer member 242. Then, the plate 245 and the collar 244 are fastened to the cylinder casing 219 by the bolts 222 passing through the collar 244 and the plate 245, thereby constituting the impact force attenuation structure.

According to such an impact force attenuation structure, at the time of the collision to the tip end tool holding member 221 at the most advanced positions of the tip end tool 232 and the intermediate member 231, the tip end tool holding member 221 advances while pressing the buffer member 242, the impact force at the time of the collision is absorbed and buffered by the elastic deformation of the buffer member 242.

SUMMARY OF THE INVENTION

However, in the impact force attenuation structure shown in FIGS. 8 and 9, the buffer member 242 is provided only on the one surface (front surface) side of the flange portion 221*a* of the tip end tool holding member 221. Thus, an impact force can be buffered by the buffer member 242 only when an impact force in the direction for advancing the tip end tool holding member is applied to the tip end tool holding member 221 like the case of the collision to the tip end tool holding member 221 at the most advanced positions of the tip end tool 232 and the intermediate member 231. As a result, there is a drawback that the buffer member 242 can not absorb nor buffer an impact force in the other direction.

In the actual operation, since the tip end tool 232 inclines, an impact force in the radial direction also generates at the tip end tool holding member 221. Thus, there arises a problem that vibration and noise are generated also by the impact force in the radial direction. The vibration and impact are generated in such cases where the tip end tool inclines and collides with the tip end tool holding member or a coming-out preventing member, the tip end tool moves reciprocally in a state that the tip end tool abuts against the inner wall of the tip end tool holding member, or the tip end tool abuts against the corning-out preventing member.

It is an object of the invention to provide a striking tool which can realize small vibration and low noise.

According to one aspect of the invention, there is provided with an striking tool including: a cylinder casing having a piston; a striker fit into the cylinder casing and freely slidable in the cylinder casing, the striker having a piston which is reciprocally movable by changing an air pressure within the air chamber; a tip end tool to which an impact force is transmitted by reciprocal movement of the piston; and a tip end tool holding member holding the tip end tool; a buffer member disposed in at least two directions in an axial direction of the striking tool, wherein the buffer member sandwiches therebetween an attachment portion of the tip end tool holding member to the cylinder casing. The tip end tool holding member is elastically supported to be movable in the two directions in the axial direction of the striking tool.

By thus configuration, since the tip end tool holding member is supported by the two buffer members each disposed at the front and rear portions thereof so as to be movable in the longitudinal direction (that is, the front and rear directions) an impact force in the longitudinal direction generated at the tip end tool holding member can be absorbed by the buffer members. Thus, noise and vibration caused by the impact force can be suppressed to realize the striking tool with low noise and small vibration. Further, the transmission of an impact force in the longitudinal direction generated at the tip end tool holding member to other members such as the cylinder casing can be interrupted or buffered. Thus, noise generated from these members can be suppressed and so the breakages of the respective portions is prevented, whereby the durable life time of the striking tool can be improved.

According to another aspect of the invention, the tip end tool holding member is elastically supported in a radial direction by the buffer member.

By thus configuration, since the tip end tool holding member is elastically supported by the buffer members so as to be movable also in the radial direction, the vibration in the radial direction generated at the tip end tool holding member due to the inclination etc. of the tip end tool can be attenuated. Further, the impact force in the radial direction generated at the tip end tool holding member due to the inclination of the tip end tool can be absorbed by the buffer members, thereby to realize the striking tool with further low noise and small vibration.

According to another aspect of the invention, the striking tool further includes: a collar inserted through the attachment portion of the tip end tool holding member to the cylinder casing and the buffer member; and a bolt inserted through the collar and engages with the cylinder casing.

By thus configuration, since the collar is inserted through the attachment portion of the tip end tool holding member to the cylinder casing and the buffer members, the fastening amount of the bolt is restricted by the collar and so the compressing amount of the buffer members in the axial direction can be restricted.

According to another aspect of the invention, an inner diameter of a hole portion of the attachment portion of the tip end tool holding member to the cylinder casing is lager than an outer diameter of the collar.

By thus configuration, since the inner diameter of the hole portion of the attachment portion of the tip end tool holding member to the cylinder casing is lager than the outer diameter of the collar, the compression amounts of the buffer members in the axial direction can be restricted. Further, the vibration and the impact force in the radial direction generated at the tip end tool holding member due to the inclination of the tip end tool is hardly transmitted to the cylinder casing, thereby to realize the striking tool with low noise and small vibration.

According to another aspect of the invention, the buffer member sandwich therebetween the attachment portion of the tip end tool holding member to the cylinder casing in a state that the buffer member is compressed.

By thus configuration, the buffer members sandwich therebetween the attachment portion of the tip end tool holding member to the cylinder casing in the state that the buffer members are compressed. Thus, when the tip end tool holding member moves, it is possible to suppress the generation of spaces in the axial direction of the tool between the buffer member and the attachment portion and also between the buffer member and the cylinder casing, thereby to realize the striking tool with further low noise and further small vibration.

According to another aspect of the invention, the striking tool further includes a buffer member disposed in two directions in the axial direction of the tool. The buffer member sandwiches therebetween an attachment portion of the cylinder casing to a casing. The cylinder casing is elastically supported to be movable in the two directions in the axial direction of the tool.

By thus configuration, in addition to the tip end tool holding member, since the cylinder casing is also supported by the two buffer members each disposed at the front and rear portions thereof so as to be movable in the longitudinal direction (that is, the front and rear directions), an impact force in the longitudinal direction generated at the tip end tool holding member can be absorbed in the two stages by the buffer members, thereby to realize the striking tool with further low noise and further small vibration.

According to another aspect of the invention, a striking tool includes: a cylinder casing having a piston; a striker fit into the cylinder casing and freely slidable in the cylinder casing, the striker having a piston which is reciprocally movable by changing an air pressure within the air chamber; a tip end tool to which an impact force is transmitted by reciprocal movement of the piston; and a tip end tool holding member holding the tip end tool; a buffer member disposed in at least two directions in an axial direction of the striking tool. The buffer member sandwiches therebetween an attachment portion of the cylinder casing to a casing. The tip end tool holding member is elastically supported to be movable in the two directions in the axial direction of the striking tool.

By thus configuration, since the cylinder casing is supported by the two buffer members each disposed at the front and rear portions thereof so as to be movable in the longitudinal direction (that is, the front and rear directions), an impact force in the longitudinal direction generated at the cylinder casing can be absorbed by the buffer members. Thus, noise and vibration caused by the impact force can be suppressed thereby to realize the striking tool with low noise and small vibration. Further, the transmission of an impact force in the longitudinal direction generated at the cylinder casing to other members such as the casing can be interrupted or buffered. Thus, noise generated from these members can be suppressed and so the breakages of the respective portions is prevented, whereby the durable life time of the striking tool can be improved.

According to another aspect of the invention, the cylinder casing is elastically supported in a radial direction by the buffer member.

By thus configuration, since the cylinder casing is elastically supported by the buffer members so as to be movable also in the radial direction, the vibration in the radial direction generated at the tip end tool holding member due to the inclination etc. of the tip end tool and transmitted to the cylinder casing can be attenuated. Further, the impact force in the radial direction generated at the tip end tool holding member due to the inclination of the tip end tool and transmitted to the cylinder casing can be absorbed by the buffer members, thereby to realize the striking tool with further low noise and further small vibration.

According to another aspect of the invention, the striking tool further includes: a collar inserted through the attachment portion of the cylinder casing to the casing and the buffer member; and a bolt inserted through the collar and engages with the casing.

By thus configuration, since the collar is inserted through the attachment portion of the cylinder casing to the casing and the buffer members, the fastening amount of the bolt is restricted by the collar and so the compressing amount of the buffer members in the axial direction can be restricted.

According to another aspect of the invention, an inner diameter of a hole portion of the attachment portion of the cylinder casing to the casing is lager than an outer diameter of the collar.

By thus configuration, since the inner diameter of the hole portion of the attachment portion of the cylinder casing to the casing is lager than the outer diameter of the collar, the compression amounts of the buffer members in the axial direction can be restricted. Further, the vibration and the impact force in the radial direction generated at the tip end tool holding member due to the inclination of the tip end tool is hardly transmitted to the casing through the cylinder casing, thereby to realize the striking tool with low noise and small vibration.

According to another aspect of the invention, the buffer member sandwich therebetween the attachment portion of the cylinder casing to the casing in a state that the buffer member is compressed.

By thus configuration, the buffer member sandwiches therebetween the attachment portion of the cylinder casing to the casing in the state that the buffer member is compressed. Thus, when the cylinder casing moves, it is possible to suppress the generation of spaces in the axial direction of the tool between the buffer member and the attachment portion and also between the buffer member and the cylinder casing, thereby to realize the striking tool with further low noise and further small vibration.

DESCRIPTION OF THE PREFERRED EMBODIMENTS

Hereinafter, an embodiment of the invention will be explained with reference to the accompanying drawings.

Figure 1:
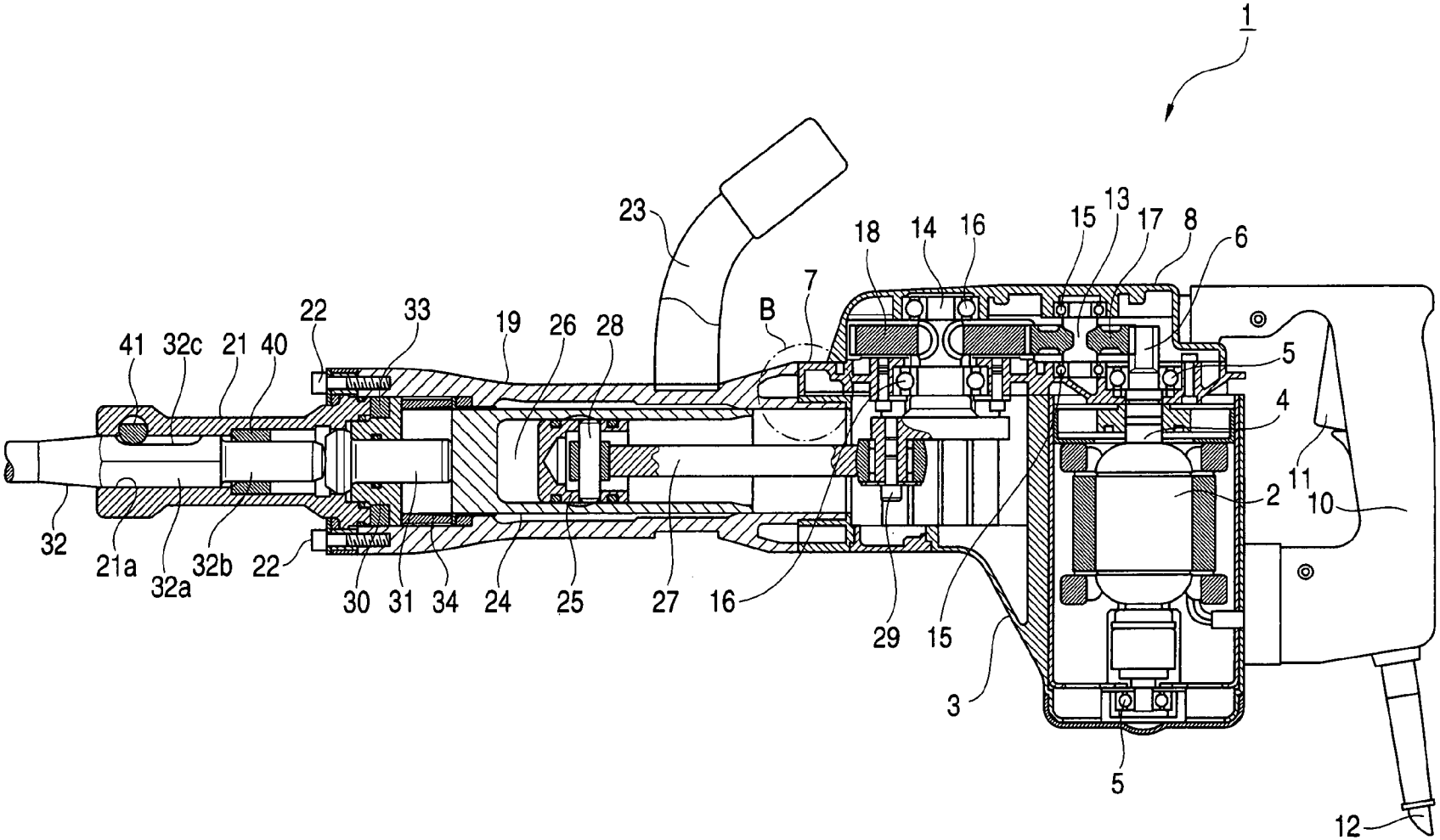
FIG. 1 is a partially-broken longitudinal sectional view of a striking tool according to the embodiment of the invention.
Figure 2:
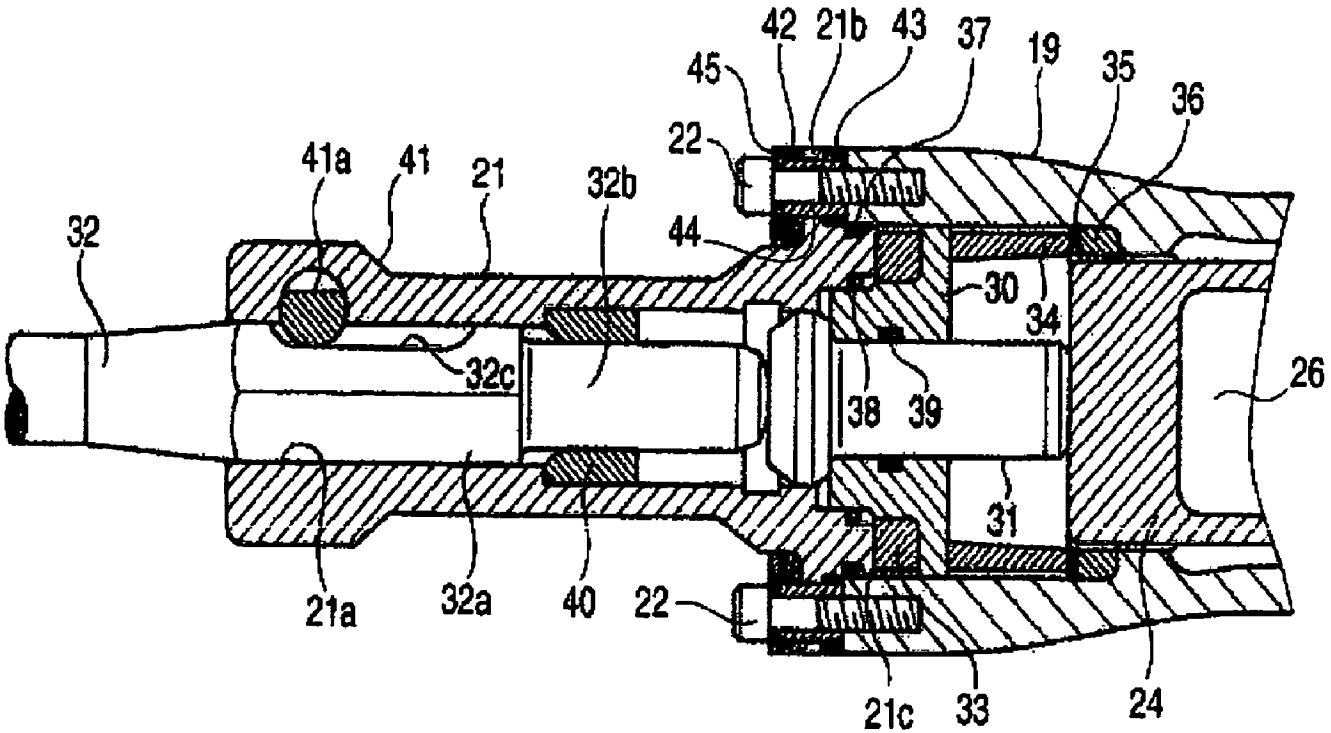
FIG. 2 is a longitudinal sectional diagram of the tip end portion of the striking tool according to the embodiment of the invention.
Figure 3:
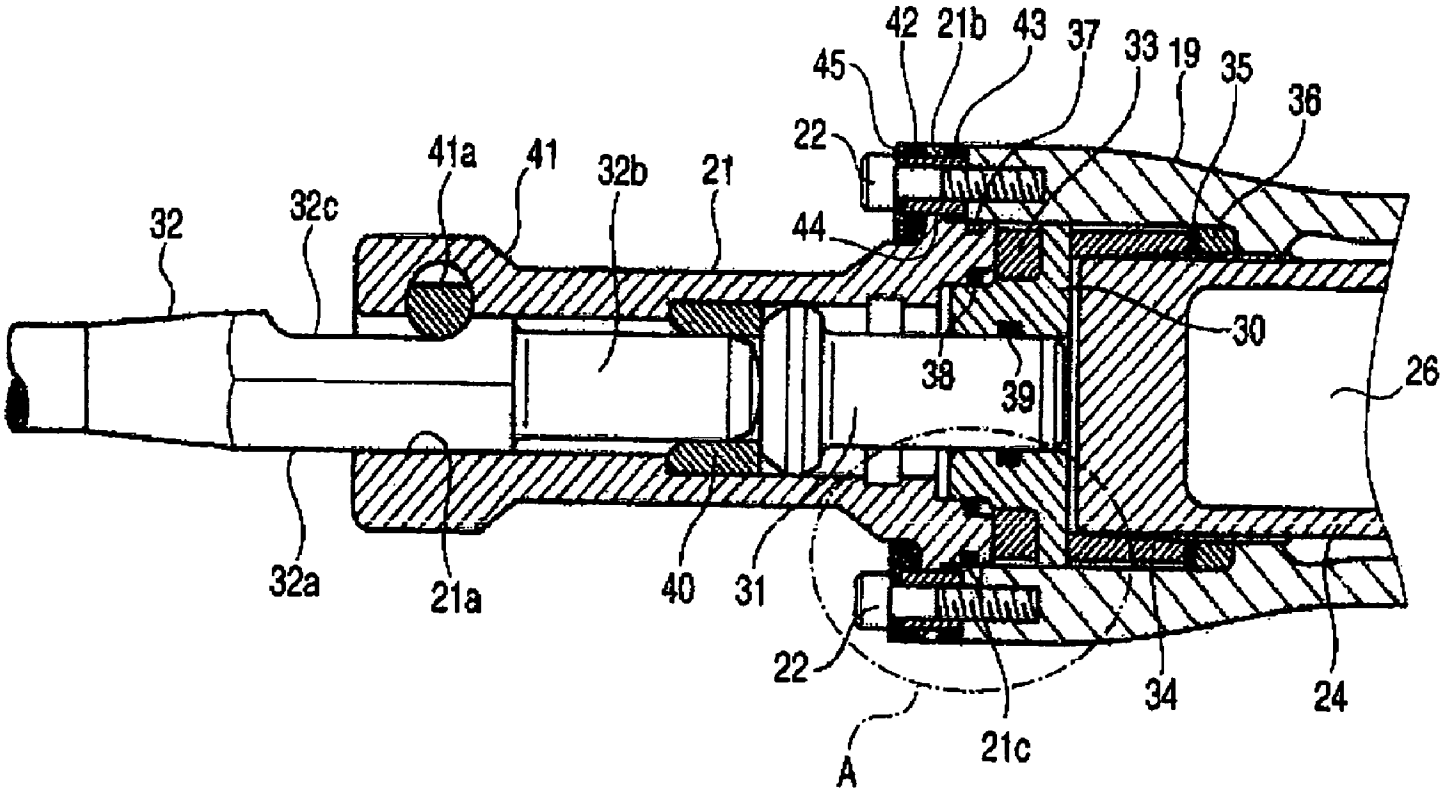
FIG. 3 is a longitudinal sectional diagram of the tip end portion of the striking tool according to the embodiment of the invention.
Figure 4:
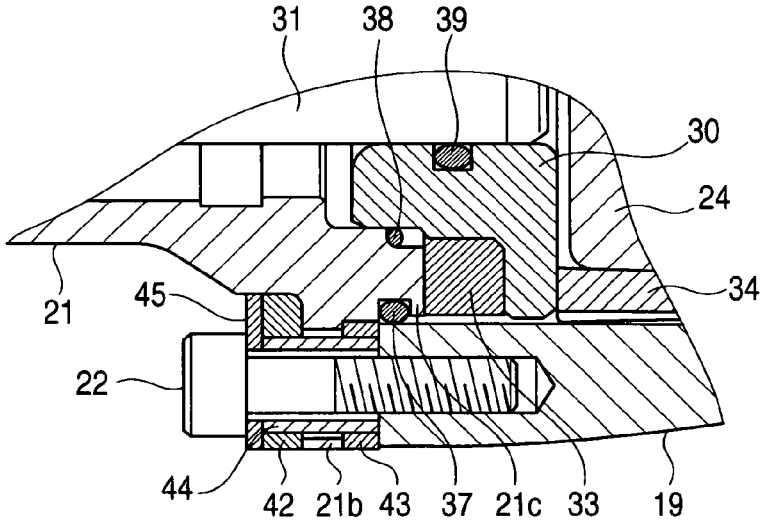
FIG. 4 is an enlarged diagram showing the details of a portion A in FIG. 3
Figure 5:
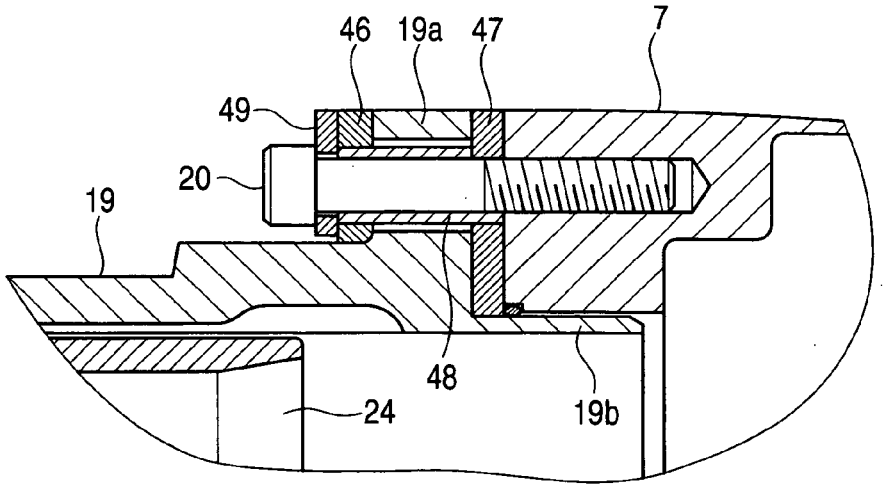
FIG. 5 is a partially sectional view showing the coupling structure of a portion B in FIG. 1.

FIG. 1 is a partially-broken longitudinal sectional view of a striking tool, FIGS. 2 and 3 are longitudinal sectional diagrams of the tip end portion of the striking tool, FIG. 4 is a an enlarged diagram showing the details of a portion A in FIG. 3, and FIG. 5 is a partially sectional view showing the coupling structure of a portion B in FIG. 1.

In the striking tool 1, as shown in FIG. 1, a motor 2 serving as a driving source is housed and disposed in a transversal state within a casing 3. An output shaft 4 extending to the vertical direction of the motor 2 is supported at its upper and lower end portions by a pair of upper and lower bearings 5 so as to rotate freely, respectively. A pinion 6 is integrally provided at the upper end portion of the output shaft 4.

An inner cover 7 is attached to the upper portion of the casing 3. A gear cover 8 is attached to the upper portion of the inner cover 7 by means of not shown bolts. The upper portion of the output shaft 4 of the motor 2 is supported so as to rotate freely by the inner cover 7 through the bearing 5.

Further, at the rear end portion of the striking tool 1, a handle 10 of a U-shape seen from the side surface side thereof is attached to the gear cover 8 and the casing 3. The handle 10 is provided with a switch 11 of push-button type for turning on/off the striking tool 1 (motor 2), and a power cord 12 continuing to the motor 2 is extracted from the lower end portion of the switch. A not-shown power plug is attached to the free end of the power cord 12.

Figure 6:
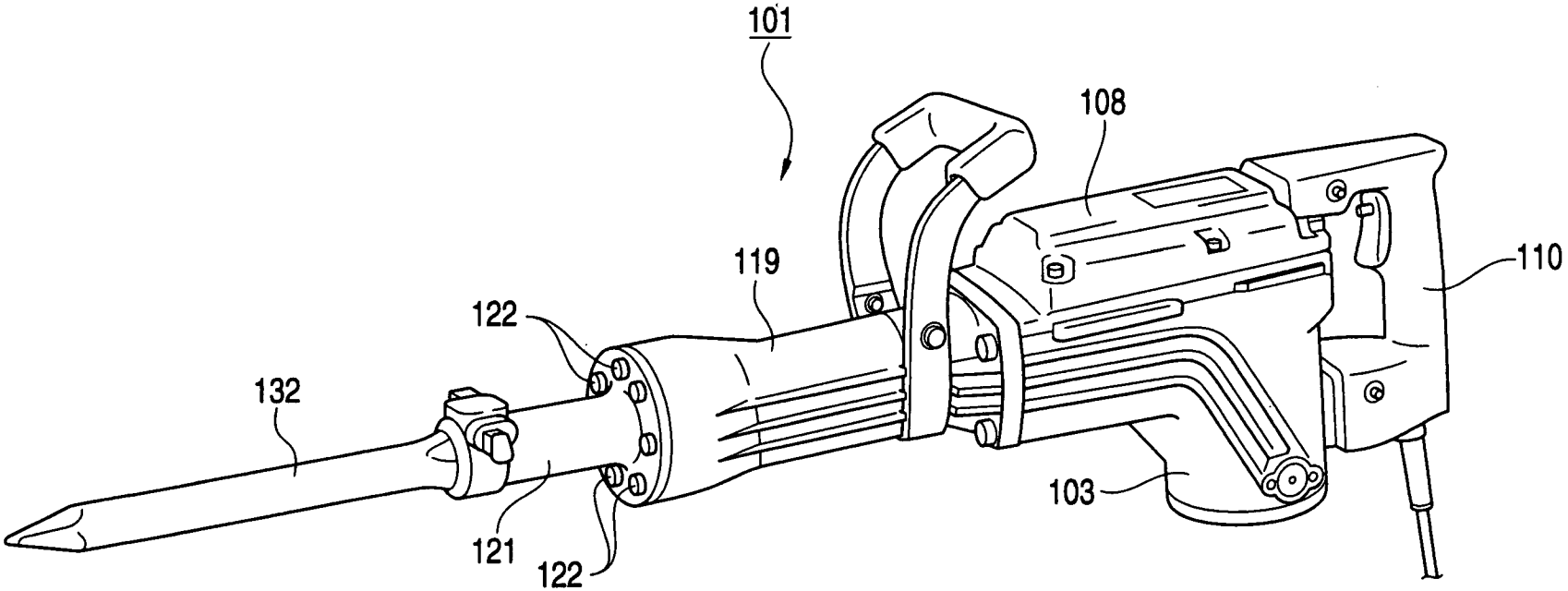
FIG. 6 is a perspective view showing the external appearance of a conventional striking tool.
Figure 7:
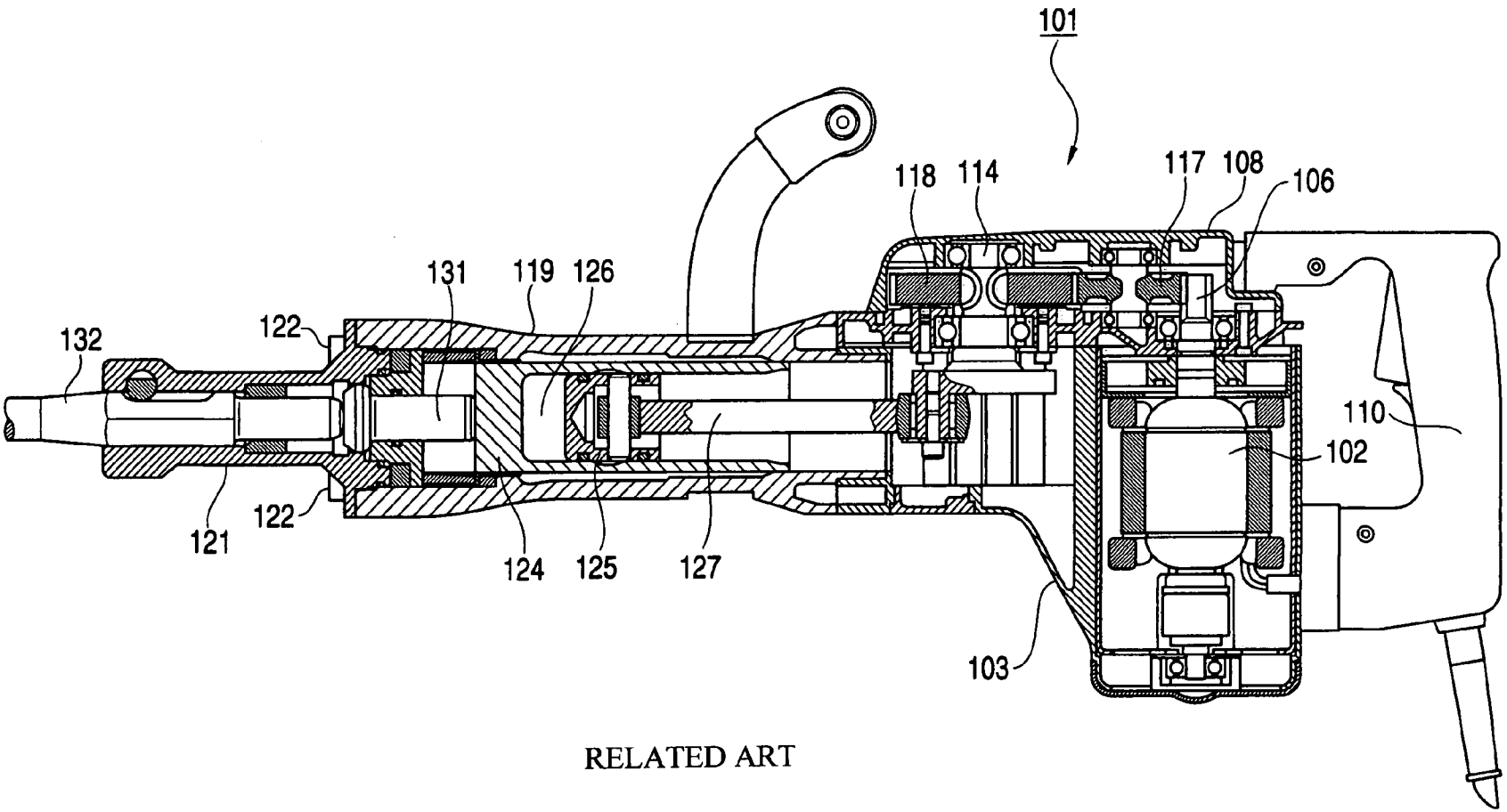
FIG. 7 is a partially-broken longitudinal sectional diagram of the conventional striking tool.
Figure 8:
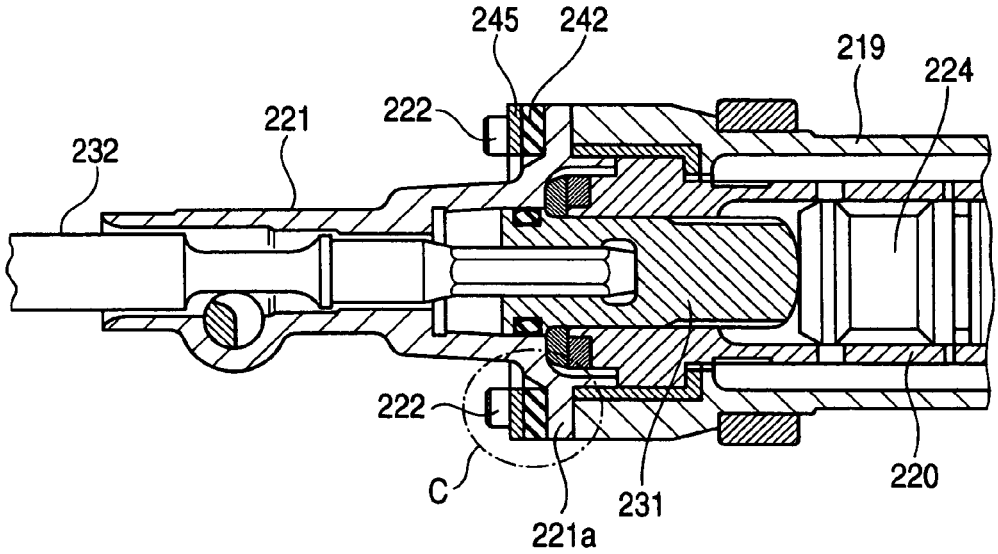
FIG. 8 is a longitudinal sectional view of the tip end portion of the conventional striking tool.
Figure 9:
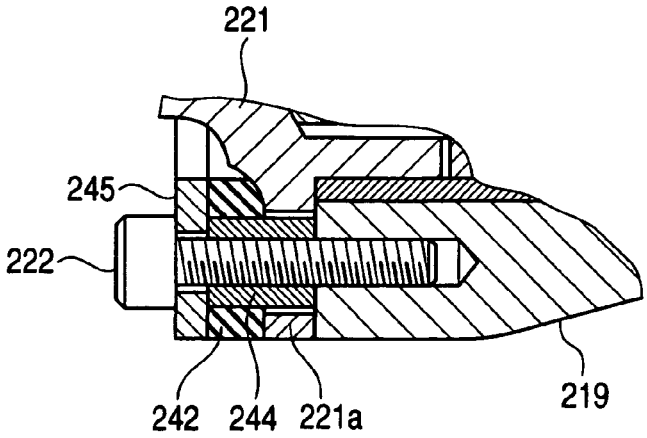
RELATED ART FIG. 9
FIG. 9 is an enlarged diagram showing the details of a portion C in FIG. 8.

On the other hand, within the gear cover 8, a counter shaft 13 and a crank shaft 14 are disposed in a vertical direction in a manner that they are supported by a pair of upper and lower bearings 15, 16 so as to rotate freely, respectively. A counter gear 17 meshed with the pinion 6 is coupled to the counter shaft 13. A final gear 18 meshed with the counter gear 17 is coupled to the crank shaft 14. The diameters of the pinion 6, the counter gear 17 and the final gear 18 are set to have larger values in this order. The pinion 6, the counter gear 17 and the final gear 18 constitute a deceleration gear mechanism The front end portion of a cylinder casing 19 of a cylindrical shape, which extends almost in the horizontal direction form the front end portion of the casing 3, is fit into the rear end portion of the casing 3 and attached thereto by means of bolts 20 (see FIGS. 1 and 6). A tip end tool holding member (holder) 21, which also extends almost in the horizontal direction, is fit into the front end portion of the cylinder casing 19 and attached thereto concentrically by means of bolts 22. A side handle 23 is attached to the outer periphery of the cylinder casing 19.

A cylindrical striker 24, having a bottom portion and opened at its rear end, is fit into the cylinder casing 19 so as to be slidable freely in the longitudinal direction thereof. A piston 25 is fit within the striker 24 so as to be able to slide freely in the longitudinal direction (striking direction). An air chamber 26 defined by the piston 25 is formed within the striker 24. The piston 25 is coupled to the crankshaft 14 through the rod 27. The rod 27 and the crank shaft 14 constitute a conversion mechanism for converting the rotation movement of the crank shaft 14 into the reciprocal linear movement of the piston 25. The one end of the rod 27 coupled to the piston 25 through a piston pin 28 and the other end thereof is coupled by a bolt 29 to a position of the lower end flange portion of the crank shaft 14 which is eccentric from the rotation center of the lower end flange portion.

Further, a shank sleeve 30 is disposed at the front end portion within the cylinder casing 19. An intermediate member 31 is inserted and held within the at the center portion of the shank sleeve 30 to be able to slide freely in the longitudinal direction. The front end of the intermediate member 31 abuts against the rear end surface of a tip end tool 32 which rear end portion is inserted and held within the tip end tool holding member 21, while the rear end of the intermediate member abuts against the front end surface of the striker 24. A ring-shaped damper 33 formed by elastic material is provided between the shank sleeve 30 within the cylinder casing 19 and the tip end tool holding member 21. At the rear side of the shank sleeve 30, there is disposed a mouse 34 of a cylindrical shape which is arranged to fix the striker 24 at the non-operation time where no load is applied to the tip end tool 32 thereby to prevent a fictitious striking. As shown in detail in FIGS. 2 and 3, a ring-shaped damper 36 is disposed between the mouse 34 and the cylinder casing 19 through a washer 35. In FIGS. 2 and 3, each of reference numerals 37, 38 and 39 depicts an O ring.

A fitting hole 21*a* of a hexagonal shape in its section is provided to penetrate the front half portion of the tip end tool holding member 21 in the longitudinal direction. A fitting portion 32*a* shaped hexagonal column formed at the rear portion of the tip end tool 32 is inserted and fit into the fitting hole 21*a* to prevent the rotation of the tip end tool 32. A rear end portion 32*b* extending backward from the fitting portion 32*a* of the tip end tool 32 is formed in a column shape and the outer periphery of the rear end portion is held by a sleeve 40 to be slidable freely.

At the front end upper portion of the tip end tool holding member 21, a coming-out preventing member 41 of a round rod shape being rotatable is provided in the direction perpendicular to the shaft (direction perpendicular to the drawing sheets in FIGS. 1 to 3). A flat surface 41*a* is formed at a portion of the coming-out preventing member 41 (see FIGS. 2 and 3). The coming-out preventing member 41 engages with a engagement groove 32*c*, which is formed at the fitting portion 32*a* of the tip end tool 32 to be elongated in the longitudinal direction, as shown in the figure thereby to prevent the coming-out of the member 32. When the coming-out preventing member 41 is rotated by 180 degrees to face the flat surface 41*a* thereof to the tip end tool 32, the tip end tool 32 can be made detachable.

The attachment structure of the tip end tool holding member 21 to the cylinder casing 19 will be explained with reference to FIGS. 2 to 4.

Buffer members 42, 43 of a ring shape each formed by elastic member such as rubber are respectively provided at the both side surfaces (the surfaces at the two directions in the axial direction of the tool) at the front and rear portions of the flange portion 21*b* which is integrally formed at the rear end portion of the tip end tool holding member 21. Collars 44 made of metal, which are disposed in the circumferential direction with a pitch of a constant angle therebetween, are passed through the buffer members 42, 43 and the flange portion 21*b* in the longitudinal direction.

A ring-shaped plate 45 made of metal is abutted against the buffer member 42 of the front side. The plate 45 and the collars 44 are fastened to the font end surface of the cylinder casing 19 by means of the bolts 22 which are inserted into the plate 45 and the collars 44 from the front direction thereof. Thus, the buffer members 42, 43 sandwich the flange portion 21*b* of the tip end tool holding member 21 with a predetermined compressing amount at the longitudinal both side surfaces thereof, respectively, whereby the tip end tool holding member 21 is elastically supported to be movable in the longitudinal direction (the axial direction of the tool) with respect to the cylinder casing 19.

A fastening amount of each of the bolts 22 is restricted by the collar 44 and so the compressing amount of each of the buffer members 42, 43 in the axial direction is restricted. That is, the lengths of the collars 44 are set to values for slightly compressing the buffer members 42, 43 when the collars are fastened, whereby the tip end tool holding member 21 can move in the longitudinal direction by an amount corresponding to the deformation values of the buffer members 42, 43. Incidentally, when the collars 44 are not provided, there the buffer members 42, 43 are made in contact with the threads of the bolts 22 to cause the stress concentration, whereby there arises a problem that the life times of the buffer members 42, 43 become short. However, since the collars 44 are provided, the buffer members 42, 43 contact with the collars 44, so that the life times of the buffer members 42, 43 can be long.

In this embodiment, as shown in detail in FIG. 4, the inner diameter of the hole portion of the flange portion 21*b* of the tip end tool holding member 21 is made larger than the outer diameter of the collar 44. As a result, there appears a space between the flange portion 21*b* and the collar 44, so that the cylinder casing 19 and the tip end tool holding member 21 can be supported by the buffer members 42, 43 to be also movable in the radial direction. Further, a space in the radial direction is formed between the tip end tool holding member 21 and the fitting portion (in-low portion) 21*c* to the cylinder casing 19, so that the vibration from the tip end tool holding member 21 can be prevented from being transmitted through the fitting portion 21*c*. When the tip end tool holding member 21 moves in the radial direction, the O rings 37, 38 deform elastically thereby to absorb the vibration.

Next, the attachment structure of the cylinder casing 19 to the casing 3 will be explained with reference to FIG. 5.

The cylinder casing 19 is also attached to the casing 3 by the coupling structure similar to that of the tip end tool holding member 21.

That is, buffer members 46, 47 of a ring shape each formed by elastic member such as rubber are respectively provided at the both side surfaces (the surfaces at the two directions in the axial direction of the tool) at the front and rear portions of a flange portion 19*a* which is integrally formed at the rear end portion of the portion 19. Collars 48 made of metal, which are disposed in the circumferential direction with a pitch of a constant angle therebetween, are passed through the buffer members 46, 47 and the flange portion 19*a* in the longitudinal direction. A ring-shaped plate 49 made of metal is abutted against the buffer member 46 of the front side. The plate 49 and the collars 48 are fastened to the font end surface of the casing 3 by means of the bolts 20 which are inserted into the plate 49 and the collars 48 from the front direction thereof. Thus, the buffer members 46, 47 sandwich the flange portion 19*a* of the member 19 with a predetermined compressing amount at the longitudinal both surfaces thereof, respectively, whereby the cylinder casing 19 is elastically supported to be movable in the longitudinal direction (the axial direction of the tool) with respect to the casing 3. In this case, the lengths of the collars 48 are set to values that the initial deflection amount of the buffer members 46, 47 are suitably restricted when the collars 48 are fastened, whereby the cylinder casing 19 can move in the longitudinal direction by an amount corresponding to the deformation values of the buffer members 46, 47.

Further, according to the embodiment, the inner diameter of the hole portion of the flange portion 19*a* of the cylinder casing 19 is made larger than the outer diameter of the collar 48. As a result, there appears a space between the flange portion 19*a* and the collar 48, so that the cylinder casing 19 and the casing 3 can be supported by the buffer members 46, 47 to be also movable in the radial direction.

Furthermore, a space in the radial direction (direction perpendicular to the axial direction of the tool) is formed at the fitting portion (in-low portion) 19*b* of the cylinder casing 19 to the casing 3, so that the cylinder casing 19 is elastically supported to be also movable in the radial direction by the buffer members 46, 47.

Next, the action of the striking tool 1 having the aforesaid configuration will be explained.

When the power plug attached to the end portion of the power cord 12 is inserted into the not-shown power socket and a worker pushes the switch 11 provided at the handle 10 while grasping the handle 10 at his one hand and the side handle 23 at his the other hand, the motor 2 is supplied with the power and so driven. Thus, the rotation of the output shaft 4 is decelerated in two stages by the pinion 6, the counter gear 17 and the final gear 18 constituting the deceleration gear mechanism and transmitted to the crank shaft 14, whereby the crank shaft 14 is driven and rotates at a predetermined speed.

The rotation movement of the crank shaft 14 is converted into the reciprocal linear movement of the piston 25 by the conversion mechanism constituted by the crank shaft 14 and the rod 27. Thus, the piston 25 moves reciprocally in the longitudinal direction within the striker 24, whereby the air pressure within the air chamber 26 formed within the striker 24 changes. Then, the striker 24 moves reciprocally in the longitudinal direction within the cylinder casing 19 due to the changes of the air pressure within the air chamber 26 and collides intermittently with the intermediate member 31. Thus, an impact force is transmitted from the intermediate member 31 to the tip end tool 32, whereby various operations such as the chipping, the crushing of the scraped member such as concrete can be performed by the tip end tool 32 to which the impact force is transmitted.

FIG. 2 shows a state where a reaction force is transmitted from the scraped member to the tip end tool 32 by the striking operation and so the tip end tool 32, the intermediate member 31 and the striker 24 move backward. In this case, the reaction force transmitted to the intermediate member 31 from the tip end tool 32 is transmitted to the shank sleeve 30 from the intermediate member 31, whereby the shank sleeve 30 moves backward together with the mouse 34 thereby to compress the damper 36. Thus, the reaction force is absorbed and buffered due to the elastic deformation of the damper 36.

When an impact force in the backward direction acts on the tip end tool holding member 21 due to the inclination of the tip end tool 32 at the time of the striking operation, the tip end tool holding member 21 moves backward due to the impact force to compress the buffer member 43 (the buffer member on the rear side) and the dampers 33, 36. Thus, the buffer member 43 and the dampers 33, 36 deform elastically to absorb and buffer the impact force. Although the residual impact force having not been completely absorbed by the buffer member 43 and the dampers 33, 36 is transmitted to the cylinder casing 19, the cylinder casing 19 moves backward due to the residual impact force to compress the buffer member 47 (the buffer member on the rear side) shown in FIG. 5, whereby the impact force can be absorbed by the elastic deformation of the buffer member 47.

Further, although the vibration and an impact force in the radial direction are generated due to the inclination of the tip end tool 32 at the time of the striking operation, the tip end tool holding member 21 and the cylinder casing 19 are elastically supported to be movable also in the radial direction by the buffer members 42, 43 and 46, 47 as described above, the vibration in the radial direction generated at the tip end tool holding member 21 can be attenuated and also the impact force can be absorbed by the elastic deformation of the buffer members 42, 43 and 46, 47.

On the other hand, when the striking operation is completed and the striking tool 1 is separated from the scraped member, the tip end tool 32 moves forward as shown in FIG. 3. Thus, since the intermediate member 31 also moves forward in accordance with the forward movement of the tip end tool 32 to collide with the sleeve 40, an impact force in the forward direction is generated at the tip end tool holding member 21. Then, the tip end tool holding member 21 moves forward due to the impact force, so that the other buffer member 42 (the buffer member on the front side) is compressed and deformed, whereby the impact force is absorbed by the elastic deformation of the buffer member 42. Although the residual impact force having not been completely absorbed by the buffer member 42 is transmitted to the cylinder casing 19 through the plate 45 and the bolt 22, the cylinder casing 19 moves forward due to the residual impact force to compress the other buffer member 42 (the buffer member on the front side) shown in FIG. 5, whereby the impact force can be absorbed by the elastic deformation of the buffer member 46.

In this case, even when an impact force in the radial direction is generated at the tip end tool holding member 21 and the cylinder casing 19 due to the inclination of the intermediate member 31, the tip end tool holding member 21 and the cylinder casing 19 are movable in the radial direction to elastically deform the buffer members 42, 43 and 46, 47. Thus, the impact force in the radial direction can be also absorbed by the buffer members 42, 43 and 46, 47.

As described above, in the striking tool 1 according to the embodiment, the tip end tool holding member 21 and the cylinder casing 19 are supported to be movable in the longitudinal direction and the radial direction by the two buffer members 42, 43 and 46, 47 disposed in the longitudinal two directions. Thus, impact forces in the longitudinal direction and the radial direction generated at the tip end tool holding member 21 can be absorbed by the buffer members 42, 43 and 46, 47. Thus, the noise and vibration caused by an impact force can be suppressed thereby to realize the striking tool 1 with low noise and small vibration.

Further, the transmission of impact forces in the longitudinal direction and the radial direction generated at the tip end tool holding member 21 to the cylinder casing 19, the casing 3, the gear cover 8 etc. can be interrupted or buffered. Thus, noise generated from these members can be suppressed and so the breakages of the respective portions is prevented, whereby the durable life time of the striking tool 1 can be improved.

Furthermore, according to the embodiment, the inner diameter of the hole portion of the flange portion 21*b* of the tip end tool holding member 21 is made larger than the outer diameter of the collar 44 and similarly the inner diameter of the hole portion of the flange portion 19*a* of the cylinder casing 19 is made larger than the outer diameter of the collar 48. Thus, there appears the space between the flange portion 21*b* and the collar 44 and also there appears the space between the flange portion 19*a* and the collar 48. As a result, the compression amounts of the buffer members 42, 43 and 46, 47 in the axial direction can be restricted. Further, the vibration and the impact force in the radial direction generated at the tip end tool holding member 21 due to the inclination of the tip end tool 32 is hardly transmitted to the cylinder casing 19, thereby to realize the striking tool 1 with further low noise and further small vibration.

Further, the buffer members 42, 43 are arranged to sandwich the flange portion 21*b* of the tip end tool holding member 21 therebetween in the compressed state of these buffer members and also the buffer members 46, 47 are arranged to sandwich the flange portion 19*a* of the cylinder casing 19 therebetween in the compressed state of these buffer members. Thus, when the tip end tool holding member 21 and the cylinder casing 19 move, there do not appear any space in the axial direction of the tool between the flange portion 21*b* and the buffer members 42, 43 and also any space in the axial direction of the tool between the flange portion 19*a* and the buffer members 46, 47. Therefore, the stable functions of the buffer members 42, 43 and 46, 47 can be secured, thereby to realize the striking tool 1 with low noise and small vibration.

Although, in the embodiment, the impact force buffer structure constituted by the longitudinal two buffer members 46, 47 is also employed at the attachment portion of the cylinder casing 19 to the inner cover 7, sufficient effects can be attained by employing the impact force buffer structure at least at the attachment portion of the tip end tool holding member 21 to the cylinder casing 19.

Each of the buffer members 42, 43 and 46, 47 may be made of resin etc. with elasticity other than rubber. The hardness of the material of the buffer members can be set arbitrarily in a range where the operability of the striking tool 1 is not degraded and the aforesaid effects can be attained. To be concrete, the hardness is considered to be suitably in a range of 80 degrees to 85 degrees of the Shore hardness (HS).

Further, in the embodiment, although the buffer members are configured to be compressed, the similar effects can be attained without compressing the buffer members. When the buffer member is configured to be compressed, the compressing amount should be changed suitably depending on the target operability.

The embodiment of the invention is useful for an electric striker or other arbitral striking tool which transmits an impact force to the tip end tool caused due to the change of the air pressure within the air chamber which is generated by the reciprocal movement of the piston within the striker thereby to perform a predetermined operation.

What is claimed is:

1. A striking tool comprising:

a cylinder casing;

a piston being disposed within the cylinder casing;

a striker being disposed within the cylinder casing, the striker being reciprocally movable by a change of an air pressure within an air chamber, the change of the air pressure being generated by a movement of the piston;

a tip end tool to which an impact force is transmitted by reciprocal movement of the piston;

an intermediate member intermediating the impact from the striker to the tip end tool;

a shank sleeve surrounding the intermediate member and placed between the cylinder casing and the intermediate member;

a first damper being disposed adjacent the striker to absorb a forward impact force of the striker through the shank sleeve;

a second damper being disposed adjacent the tip end tool to absorb a backward impact force of the tip end tool through the shank sleeve;

a tip end tool holding member holding the tip end tool and having an attachment portion attached to the cylinder casing;

a first buffer member, a second buffer member, wherein the attachment portion of the tip end tool holding member is sandwiched between said first buffer member and said second buffer member in an axial direction of the striker;

a collar inserted through a hole portion of the attachment portion of the tip end tool holding member the first buffer member, and the second buffer member; and a bolt inserted through the collar to engage the tip end tool holding member with the cylinder casing, wherein an inner diameter of the hole portion of the attachment portion of the tip end tool holding member is larger than an outer diameter of the collar such that an empty space is disposed between the attachment portion and the collar.

2. A striking tool according to claim 1, wherein the tip end tool holding member is elastically supported in a radial direction of the tip end tool holding member by the first buffer member.

3. A striking tool according to claim 1, wherein the first buffer member sandwiches the attachment portion of the tip end tool holding member in a state that the first buffer member is compressed.

4. A striking tool according to claim 1, wherein the cylinder casing is elastically supported to the casing of the striking tool so as to be movable in two directions of the axial direction of the striking tool.

5. A striking tool according to claim 4, wherein the second buffer member comprises third and fourth elastic members disposed on opposite faces of the attachment portion.

6. A striking tool according to claim 4, wherein the cylinder casing and the casing of the striking tool are supported by the second buffer member to be movable in the radial direction of the striking tool.

7. A striking tool according to claim 4, further comprising a vibration damping portion formed by a gap between a fitting portion of the cylinder casing and the casing of the striking tool that prevents vibration from being transmitted through the cylinder casing.

8. A striking tool according to claim 1, wherein the cylinder casing and the tip end tool holding member are supported by the first buffer member to be movable in the radial direction of the striking tool.

9. A striking tool according to claim 1, further comprising a vibration damping portion formed by a gap between a fitting portion of the tip end tool holding member and the cylinder casing that prevents vibration from being transmitted through the tip end tool holding member.

10. A striking tool according to claim 1, wherein the first buffer member comprises first and second elastic members disposed on opposite faces of the attachment portion of the tip end tool holding member.

11. A striking tool according to claim 1, wherein the tip end tool holding member is reciprocally movable in the axial direction of the striking tool.

12. A striking tool comprising:

a cylinder casing;

a piston being disposed within the cylinder casing;

a striker being disposed within the cylinder casing, the striker being reciprocally movable by a change of an air pressure within an air chamber, the change of the air pressure being generated by a movement of the piston;

a tip end tool to which an impact force is transmitted by reciprocal movement of the piston;

an intermediate member intermediating the impact from the striker to the tip end tool;

a shank sleeve surrounding the intermediate member and placed between the cylinder casing and the intermediate member;

a first damper being disposed adjacent the striker to absorb a forward impact force of the striker through the shank sleeve;

a second damper being disposed adjacent the tip end tool to absorb a backward impact force of the tip end tool through the shank sleeve;

a tip end tool holding member holding the tip end tool;

an attachment portion of the cylinder casing being attached to a casing of the striking tool;

a buffer member, having a first portion and a second portion, the attachment portion of the cylinder casing being sandwiched between said first portion and said second portion in an axial direction of the striker;

a collar inserted through a hole portion of the attachment portion of the cylinder casing, and the buffer member; and a bolt inserted through the collar to engage the cylinder casing with the casing of the striking tool, wherein an inner diameter of the hole portion of the attachment portion of the cylinder casing is larger than an outer diameter of the collar such that an empty space is disposed between the attachment portion and the collar.

13. A striking tool according to claim 12, wherein the cylinder casing is elastically supported in a radial direction of the cylinder casing by the buffer member.

14. A striking tool according to claim 12, wherein the buffer member sandwiches therebetween the attachment portion of the cylinder casing to the casing in a state that the buffer member is compressed.

15. A striking tool comprising:

a cylinder casing;

a striker being disposed within the cylinder casing;

a tip end tool to which an impact force is transmitted by reciprocal movement of the piston;

an intermediate member intermediating the impact from the striker to the tip end tool;

a shank sleeve surrounding the intermediate member and placed between the cylinder casing and the intermediate member;

a first damper being disposed adjacent the striker to absorb a forward impact force of the striker through the shank sleeve;

a second damper being disposed adjacent the tip end tool to absorb a backward impact force of the tip end tool through the shank sleeve;

a tip end tool holding member holding the tip end tool and having an attachment portion attached to the cylinder casing;

a first buffer member;

a second buffer member, wherein the attachment portion of the tip end tool holding member is sandwiched between said first buffer member and said second buffer member in an axial direction of the striker;

a collar inserted through a hole portion of the attachment portion of the tip end tool holding member the first buffer member, and the second buffer member; and a bolt inserted through the collar to engage the tip end tool holding member with the cylinder casing, wherein the tip end tool holding member is elastically supported by the cylinder casing to be movable in two directions in an axial direction of the striking tool, and an inner diameter of the hole portion of the attachment portion of the tip end tool holding member is larger than an outer diameter of the collar such that an empty space is disposed between the attachment portion and the collar.

16. A striking tool comprising:

a cylinder casing;

a striker being disposed within the cylinder casing;

a tip end tool to which an impact force is transmitted by reciprocal movement of the piston;

an intermediate member intermediating the impact from the striker to the tip end tool;

a shank sleeve surrounding the intermediate member and placed between the cylinder casing and the intermediate member;

a first damper being disposed adjacent the striker to absorb a forward impact force of the striker through the shank sleeve;

a second damper being disposed adjacent the tip end tool to absorb a backward impact force of the tip end tool through the shank sleeve;

a tip end tool holding member holding the tip end tool and having an attachment portion attached to the cylinder casing;

a buffer member, having a first portion and a second portion, the attachment portion of the tip end tool holding member being sandwiched between said first portion and said second portion in an axial direction of the striker;

a collar inserted through a hole portion of the attachment portion of the tip end holding member and the buffer member; and a bolt inserted through the collar to engage the tip end tool holding member with the cylinder casing, wherein the tip end tool holding member is elastically supported by the cylinder casing to be movable in two directions in an axial direction of the striking tool, and an inner diameter of the hole portion of the attachment portion of the tip end tool holding member is larger than an outer diameter of the collar such that an empty space is disposed between the attachment portion and the collar.

17. A striking tool comprising:

a cylinder casing;

a motor casing;

a piston being disposed within the cylinder casing;

a striker being disposed within the cylinder casing, the striker being reciprocally movable by a change of an air pressure within an air chamber, the change of the air pressure being generated by a movement of the piston;

a tip end tool to which an impact force is transmitted by reciprocal movement of the piston;

a tip end tool holding member holding the tip end tool and having an attachment portion which is to be attached to the cylinder casing and extending in a direction perpendicular to an axial direction of the striker, the attachment portion having a hole;

said cylinder casing having a flange portion which is to be attached to the motor casing and is extending in a direction perpendicular to the axial direction of the striker, the flange portion having a hole;

an intermediate member intermediating the impact from the striker to the tip end tool;

a shank sleeve surrounding the intermediate member and placed between the cylinder casing and the intermediate member;

a first damper being disposed between an end face of the tip end tool holding member and the shank sleeve to absorb a forward impact force of the striker through the shank sleeve;

a second damper being disposed between the cylinder casing and the shank sleeve to absorb a backward impact force of the top end tool through the shank sleeve;

a first buffer, having a first portion and a second portion, the attachment portion of the tip end tool holding member being sandwiched between said first portion and said second portion in the axial direction of the striker;

a first collar extending in the axial direction of the striker and inserted through the hole of the attachment portion of the tip end tool holding member, and the buffer member;

a second buffer having a third portion and a fourth portion, the flange portion of the cylinder casing being sandwiched between the third portion and the fourth portion in the axial direction of the striker; and a second collar extending in the axial direction of the striker and inserted through the hole of the flange portion wherein an inner diameter of the hole portion of the attachment portion of the tip end tool holding member is larger than an outer diameter of the first collar such that an empty space is formed between the attachment portion and the first collar, and an inner diameter of the hole of the flange portion of the cylinder casing is larger than an outer diameter of the second collar such that an empty space is formed between the flange portion and the second collar.

* * * * *